United States Patent [19]

Lin

[11] Patent Number: 4,490,895

[45] Date of Patent: Jan. 1, 1985

[54] METHOD FOR PRODUCING CLEANSING AND WIPING CLOTH

[76] Inventor: P. H. Lin, 5, Ln. 131, Section 2, Mei Liao Rd., Kan Ching Li, Ho Mei Chen, Chang Hua Hsien, Taiwan

[21] Appl. No.: 310,815

[22] Filed: Oct. 13, 1981

[51] Int. Cl.[3] ..... A47L 13/16

[52] U.S. Cl. ..... 28/143; 15/209 R; 112/441

[58] Field of Search ..... 28/143; 427/308, 324; 112/441; 428/102; 8/108 A, 127; 15/208, 209 R

[56] References Cited

U.S. PATENT DOCUMENTS 3,247,009 4/1966 Franey ..... 427/308

4,144,612 3/1979 Yamaguchi ..... 112/441 X

*Primary Examiner*—Robert Mackey

*Attorney, Agent, or Firm*—Armstrong, Nikaido, Marmelstein & Kubovcik

[57] ABSTRACT

The present invention relates to a method for producing a cleansing and wiping cloth, particularly a cloth of low density wefts and warps formed by interwoven 100% count No. 20 rayon yarn which is treated by chemicals. The treatment includes starching the yarn with cassava starch and CMC having the property of suspending contaminant particles, softening the yarn by a mixture of hydrogen peroxide and a softening agent. The fillers may completely fill up the non-crystalline space of the fibers and cling to the surface of the cloth. The cloth is, in turn, pulled by rollers and ironed, and scissored into pieces of proper size. At least six such pieces are stacked together and hemmed around the periphery to form an entity. The structure is further reinforced by stitching, thereby forming a cleansing and wiping cloth which exhibits excellent absorptivity to moisture, which is easy to dry, and which does not retain any contaminant or unpleasant smell.

5 Claims, 5 Drawing Figures

METHOD FOR PRODUCING CLEANSING AND WIPING CLOTH

This invention concerns a method for producing a cleansing and wiping cloth which exhibit excellent resistance to wear, and absorptivity to moisture, and does not retain foul matters.

Generally, wiping cloths are made of worn cotton, linen or synthetic fibers. Because they are not subject to proper chemical and physical treatment, their absorptivity of moisture is relatively poor. With respect to capacity for drying cotton yarns, for example, have certain problems. When liquid is absorbed and enters the interior of the yarn, the spaces between the yarns are so narrow that they may hamper the capillary penetration of the fibers. The vaporization of water from the cloth is also poor. Moreover, foul matters tend to be retained in the interfibrous space. These are not only very difficult to remove, but results in the further accumulation of such foul matters. As a result, a wiping cloth, after repeated use, is badly stained, gives out an unpleasant ordor, and is thus reduced to a hotbed of pathogenic microbes.

Accordingly, it is the main object of this invention to provide an improved wiping cloth whereby the aforesaid defects are obviated or mitigated.

It is a further object of this invention to provide a method for the production of the same.

The objects and features of the present invention are set forth in the appended claims. The present invention may be best understood by reference to the following description, taken in connection with the accompanying drawings in which, like numerals indicate like parts.

DETAILED DESCRIPTION

The manufacturing process according to this invention is described in sequence as follows:

Warp standards are prepared by twisting fibers into yarn of count No. 20. The yarn is then reinforced with CMC, which is most suitable to rayon as a starching agent so that the yarn does not nap electrostatically in the stitching process. Table 1 shows the influence of various starching agents with respect to the properties of synthetic fibers.

TABLE 1

| Starching agent | Strength | Tensility (%) | Enduance to wear (times) |
|---|---|---|---|
| PVA | 210 | 7.8 | 300 |
| Potato starch | 212 | 9.5 | 107 |
| CMC | 200 | 9.1 | 356 |

Figure 1A:
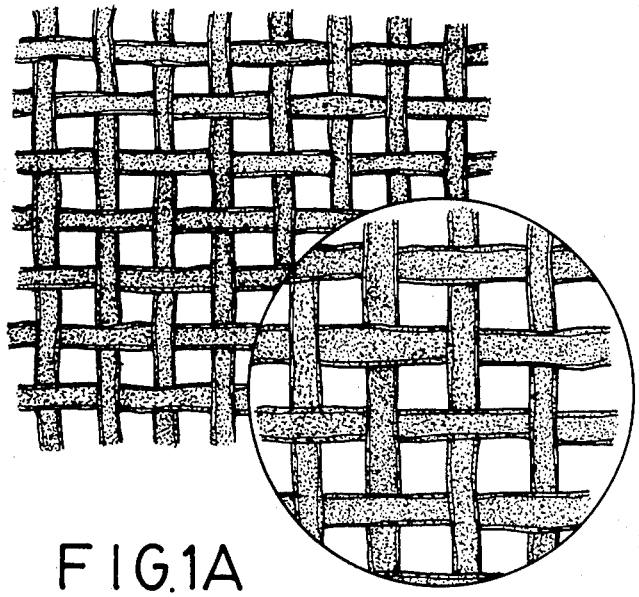
FIGS. 1A and 1B are, respectively, an enlarged sectional views of this invention showing the interwoven weft and warp yarns in wet and dry conditions.
Figure 1B:
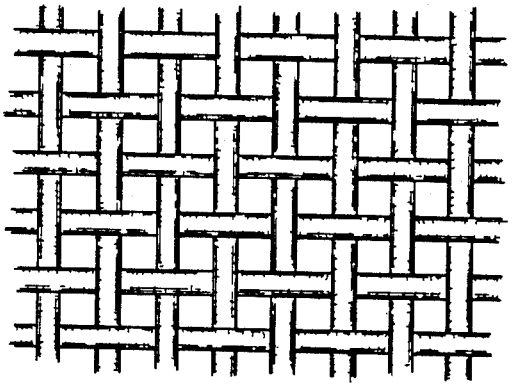
Figure 2:
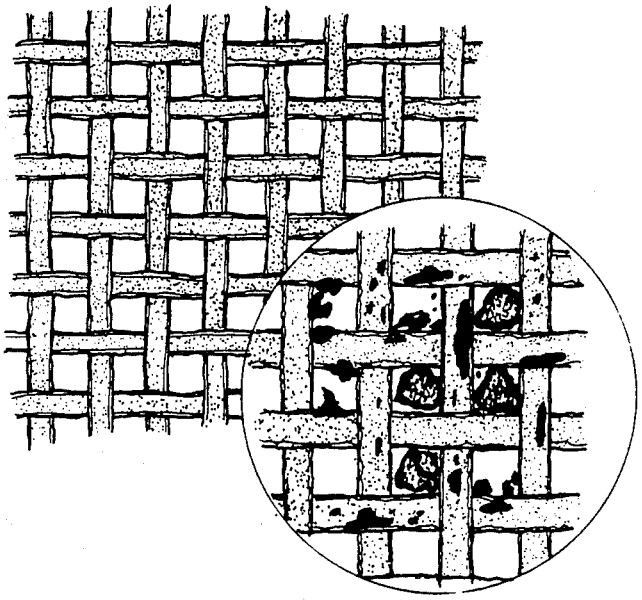
FIG. 2 is an enlarged sectional view microscopically showing the cloth with and without contaminating particles.

The weft strands are prepared in the same manner as the warp strands to obtain count No. 20 wefts. The weft yarns together with the foregoing warp yarns are interwoven to give the unit pieces. Microscopic views are shown in FIGS. 1A, 1B and FIG. 2. The warp yarns and weft yarns are interwoven into simple lattices, which leave relatively large interstices, estimated at $19\times19/\text{inch}^2$. These are larger than ordinary fabrics.

The unit pieces are then subjected to a bleaching treatment in sodium hypochlorite (NaO CL) solution of 1:20 by volume, with about 0.5% sulfate to make the surface of the cloth somewhat rough to facilitate the removal of dirt from the wiped surfaces. The cloth is then dipped and swollen in a dilute solution of sodium hydroxide to facilitate successive treatments.

After the cloth has been sufficiently swollen, a filling process is performed using 2.5% CMC and 2.5% Cassava paste as an adhesive (starching liquid). Since the viscosity of CMC decreases with the increase of temperature, it is adapted to be starched at low temperature. The film of adhesive has a tensile strength of up to 30.1 g, with a bending degree of 2.4%, and a tensility of 3.5%. The addition of Cassava starch, although temporarily stiffening the yarn and resulting in the loss of its resilence, endows the cloth with a slightly appearance and a good tactile feel.

Then the cloth is submerged in a mixture containing 4.3% hydrogen peroxide and softening agent at 50°-60° C. for two hours so that the surface film of the yarn becomes flexiby soft yet still resilient and tough enough to withstand folding and tension. This also contributes to the starching of the yarns, thereby giving a smooth surface which is more resistant to friction.

The cloth is then guided through rollers at high temperature (130° C.-140° C.). The cloth is calendered under tension. Meanwhile, the chemicals are all pressed to be incorporated into the yarn, thereby finishing the filling process. This not only strengthens the whole cloth, but fills up or flattens the uneven portions of the yarn. Consequently, dirt can only be held at the surface of the yarns and does not infiltrate into the interior thereof. This facilitates the after-use cleaning of the cloth.

Figure 3:
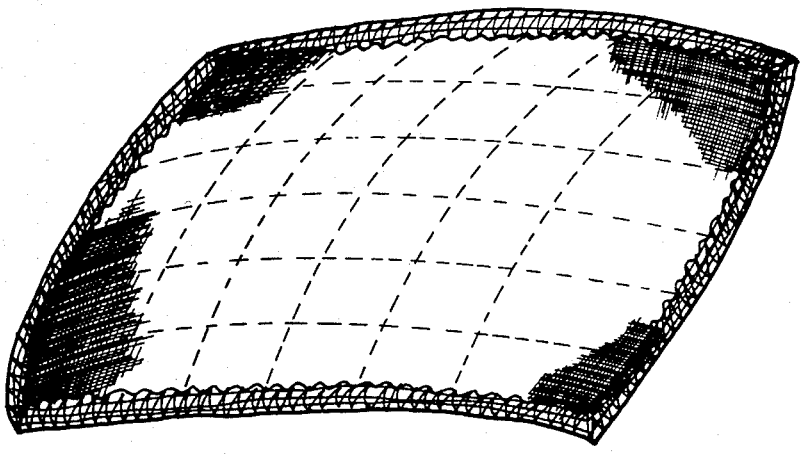
FIG. 3 is a perspective view of this invention.
Figure 4:
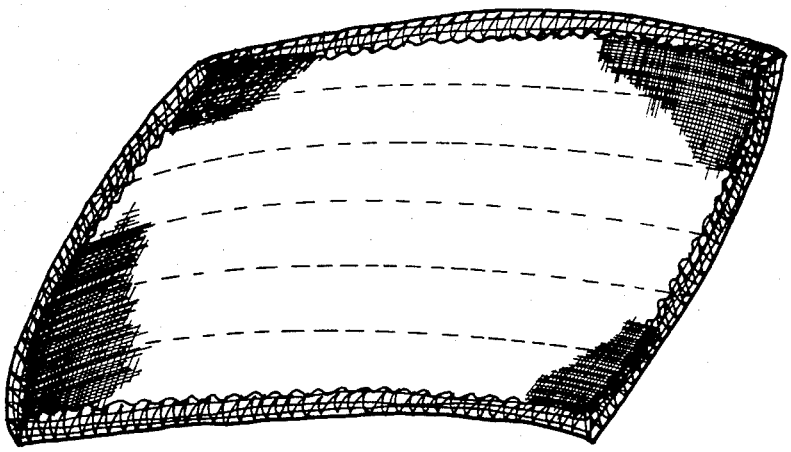
FIG. 4 is a perspective view of another modification of this invention.
Figure 5:
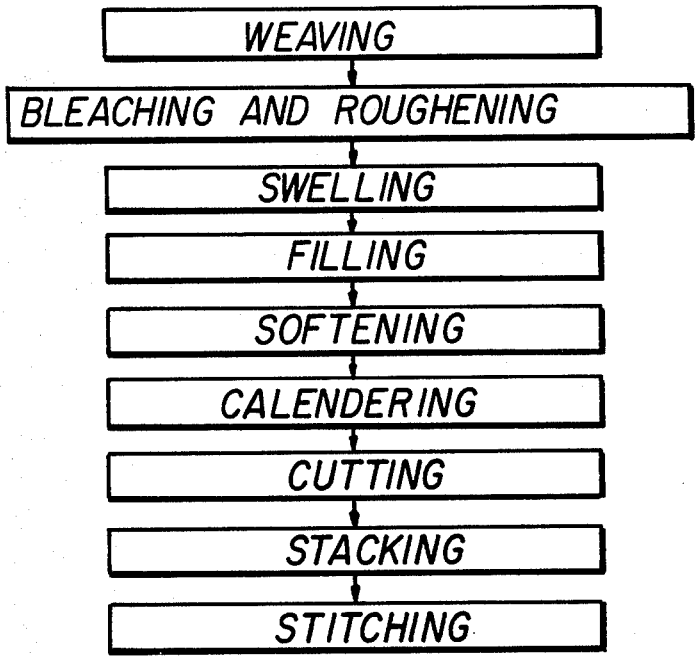
FIG. 5 is a flow chart of the steps of the present invention.

Having been subject to the aforementioned treatments, the cloth is cut into square pieces of proper size ($30\times30$), which are then stacked together by six to nine layers to form an entity. The structure is further strengthened. Owing to the lack of elasticity of the rayons which is used in this invention, additional stitching through the superposed layers is required. In FIG. 3 and FIG. 4, there are shown two different types of stitching.

If any contaminating particles are drawn into the cloth through capillary force into the interstices of the interwoven warps and wefts, because these yarns are twisted of 100% rayons which is not penetrable by liquid and which forms a film at the surface due to chemical treatments, the contaminating particles cannot enter the interior of the yarns. Thus, by floating the wiping cloth in water, the contaminants can be easily removed without leaving a trace. Hence, even after repeated use, the wiping cloth still looks as new as before. It will be apparent to those skilled in the art that various modifications of the present invention are possible, and accordingly the scope of the present invention should be interpreted solely from the following claims.

I claim:

1. A method for producing a wiping cloth, comprising the following steps:

forming a cloth with low density of interwoven warp and weft yarns of 100% rayon;

bleaching the cloth, treating the cloth with dilute sulfate to make its surface somewhat rough, and dipping it in dilute base to swell it;

starching the cloth, softening it, and calendering it.

cutting the resulting cloth into pieces of proper size, stacking a plurality of such pieces, together to form multi-layered structure;

reinforcing the structure by stitching through the layers.

2. The method according to claim 1, wherein the surface of said cloth is made rough by 0.5% sulfate, and swollen by 4% NaOH.

3. The method according to claim 1, wherein said cloth is bleached by hypochlorite.

4. The method according to claim 1, wherein said starching process includes starching the cloth by a mixture containing 2.5% CMC and 2.5% cassava starch as adhesive.

5. The method according to claim 1, wherein the calendering process is carried out by hot rollers at 130°–140° C.

* * * * *